US005107648A

United States Patent [19]

Roby

[11] Patent Number: 5,107,648

[45] Date of Patent: Apr. 28, 1992

[54] INSULATED WALL CONSTRUCTION

[76] Inventor: Edward F. Roby, P.O. Box 32157, Palm Beach Gardens, Fla. 33420

[21] Appl. No.: 657,418

[22] Filed: Feb. 19, 1991

[51] Int. Cl.[5] ..... E04B 1/18

[52] U.S. Cl. ..... 52/309.12; 52/426; 52/564; 52/699

[58] Field of Search ..... 52/426, 428, 309.12, 52/564, 699; 249/216, 217, 43, 39, 16

[56] References Cited

U.S. PATENT DOCUMENTS

| | | | |
|---|---|---|---|
| 1,782,897 | 11/1930 | Hudgin | 249/216 |
| 2,160,489 | 5/1939 | Spies | 249/216 |
| 3,625,470 | 12/1971 | Shoemaker | 249/43 |
| 4,669,234 | 1/1987 | Wilnau | 52/426 |
| 4,972,646 | 11/1990 | Miller et al. | 52/309.12 |

FOREIGN PATENT DOCUMENTS

| | | | |
|---|---|---|---|
| 645196 | 6/1928 | France | 249/216 |
| 21893 | of 1913 | United Kingdom | 52/564 |

*Primary Examiner*—James L. Ridgill, Jr.
*Attorney, Agent, or Firm*—Leon Gilden

[57] ABSTRACT

An insulated wall construction is provided utilizing spaced planar rigid foam plates, each foam plate including an upstanding rib formed about an upper and forward edge of each section, with a complementary groove formed through each rear and bottom edge of each section. The construction includes a spacer rod positioned medially of the sections, the spacer rod receivable within a rod support, the rod support fixedly secured orthogonally to an external support plate, wherein the rod is directed through each section to receive the spaced rod therewithin. The spacer rod includes a plurality of apertures between each lock pin and capture an internal support plate between each lock pin and each interior space of each section. A temporary support member is provided to provide support to stacked sections for reception of concrete between the spaced sections to permit curing of concrete in a fixed orientation.

1 Claim, 6 Drawing Sheets

PRIOR ART

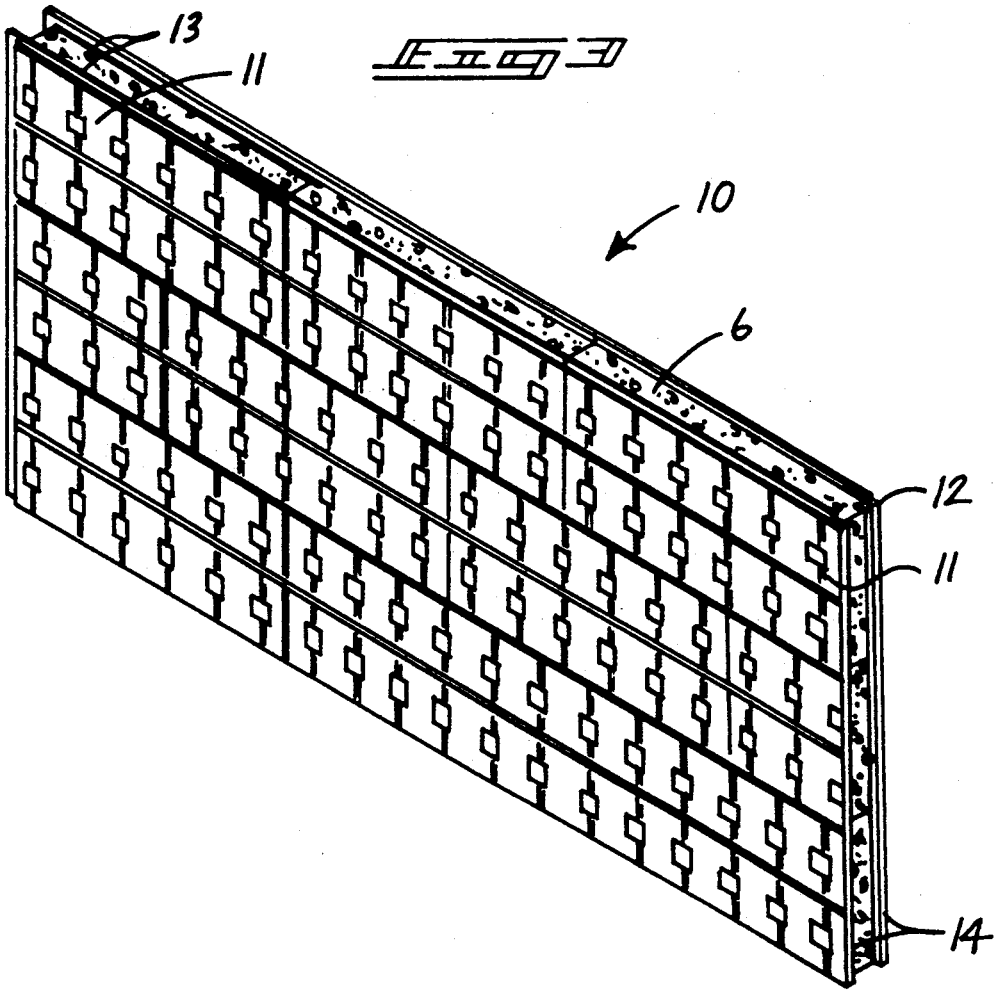
FIG 3
FIG 4
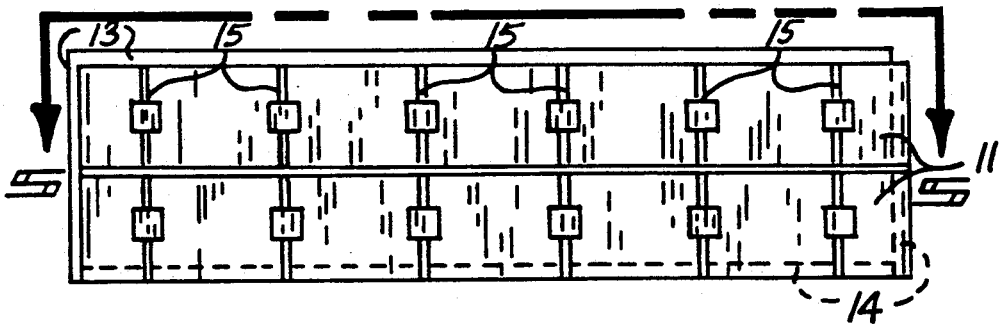
FIG 5
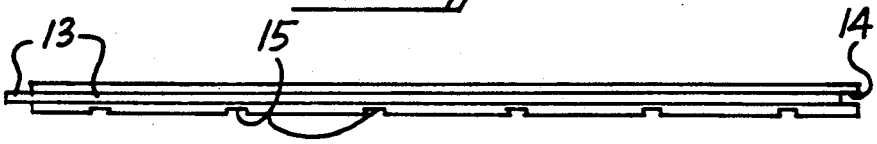

INSULATED WALL CONSTRUCTION

BACKGROUND OF THE INVENTION

1. Field of the Invention

The field of invention relates to insulated wall construction, and more particularly pertains to a new and improved insulated wall construction wherein the same utilizes semi-rigid foam section plates fixedly spaced apart relative to one another to receive concrete directed therebetween.

2. Description of the Prior Art

The use of insulated composite concrete walls utilizing relatively planar insulative sheet as concrete forms have been utilized in the prior art. Heretofore, the construction and assembly of such units have been of a relatively complex and unnecessarily cumbersome organization to permit rapid erection and deployment throughout a building site. The instant invention attempts to overcome deficiencies of the prior art by providing a readily assembled and integral unit that accommodates finishing securement of sheet rock panels, as well as the accommodation of various thicknesses of poured concrete in a "green" state directed within the cavity defined between the planar insulated sheets. Examples of prior art structures include U.S. Pat. No. 4,750,308 to McKay setting forth an insulated wall construction utilizing spaced planar foam sheets with sheet metal plates secured together by twisted tie rods defined as an integral unit, wherein the central unit is preconstructed and slid within recesses formed within the sheet, as opposed to the instant invention permitting subsequent assembly of the medial unit subsequent to positioning of the spaced sheet-like sections.

U.S. Pat. No. 4,604,843 to Ott, et al. sets forth a concrete framework utilizing foam material secured together by a ladder-like medial member of integral construction.

U.S. Pat. No. 4,706,429 to Young sets forth a form construction utilizing spaced concrete forming panels secured together by a cross tie rod relationship.

U.S. Pat. No. 4,742,659 to Meilleur utilizes a series of plastic foam modules disposed in secured relationship utilizing a matrix of cross links to secure the modules together in a both lateral and vertical orientation relative to the modules.

U.S. Pat. No. 4,698,947 to McKay sets forth a further example of securing spaced foam panels together utilizing an integral medial support member interfitted within a slot structure between the spaced panels.

As such, it may be appreciated that there continues to be a need for a new and improved insulated wall construction wherein the same addresses both the problems of ease of use as well as effectiveness in construction in accommodating poured concrete medially of spaced planar sheets permitting on-site immediate erection of such wall sections and in this respect, the present invention substantially fulfills this need.

SUMMARY OF THE INVENTION

In view of the foregoing disadvantages inherent in the known types of insulated wall constructions now present in the prior art, the present invention provides an insulated wall construction wherein the same utilizes spaced planar foam sheet members utilizing spaced positioning units mounted an equal distance throughout the wall construction to maintain the planar panels in a fixed relationship, as well as providing support for covering material such as sheet rock, stucco, and the like. As such, the general purpose of the present invention, which will be described subsequently in greater detail, is to provide a new and improved insulated wall construction which has all the advantages of the prior art insulated wall constructions and none of the disadvantages.

To attain this, the present invention includes an insulated wall construction utilizing spaced planar foam plates, each foam plate including an upstanding rib formed about an upper and forward edge of each section, with a complementary groove formed through each rear and bottom edge of each section. The construction includes a spacer rod positioned medially of the sections, the spacer rod receivable within a rod support, the rod support fixedly secured orthogonally to an external support plate, wherein the rod is directed through each section to receive the spacer rod therewithin. The spacer rod includes a plurality of apertures to receive a lock pin and capture an internal support plate between each lock pin and each interior space of each section. A support member is provided to provide support to stacked sections for reception of concrete between the space sections to permit curing of concrete in a fixed orientation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved insulated wall construction which has all the advantages of the prior art insulated wall construction and none of the disadvantages.

It is another object of the present invention to provide a new and improved insulated wall construction which may be easily and efficiently manufactured and marketed.

It is a further object of the present invention to provide a new and improved insulated wall construction which is of a durable and reliable construction.

An even further object of the present invention is to provide a new and improved insulated wall construction which is susceptible of a low cost of manufacture with regard to both materials and labor, and which accordingly is then susceptible of low prices of sale to the consuming public, thereby making such insulated wall constructions economically available to the buying public.

Still yet another object of the present invention is to provide a new and improved insulated wall construction which provides in the apparatuses and methods of the prior art some of the advantages thereof, while simultaneously overcoming some of the disadvantages normally associated therewith.

Still another object of the present invention is to provide a new and improved insulated wall construction wherein the same permits on-site erection and fabrication of wall units accommodating poured concrete therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention utilizing a matrix of wall units secured together to receive poured concrete therebetween.

FIG. 4 is an orthographic frontal view, taken in elevation, of a plurality of wall units utilized by the instant invention.

FIG. 5 is an orthographic view, taken along the lines 5—5 of FIG. 4 in the direction indicated by the arrows.

DESCRIPTION OF THE PREFERRED EMBODIMENT

Figure 1:
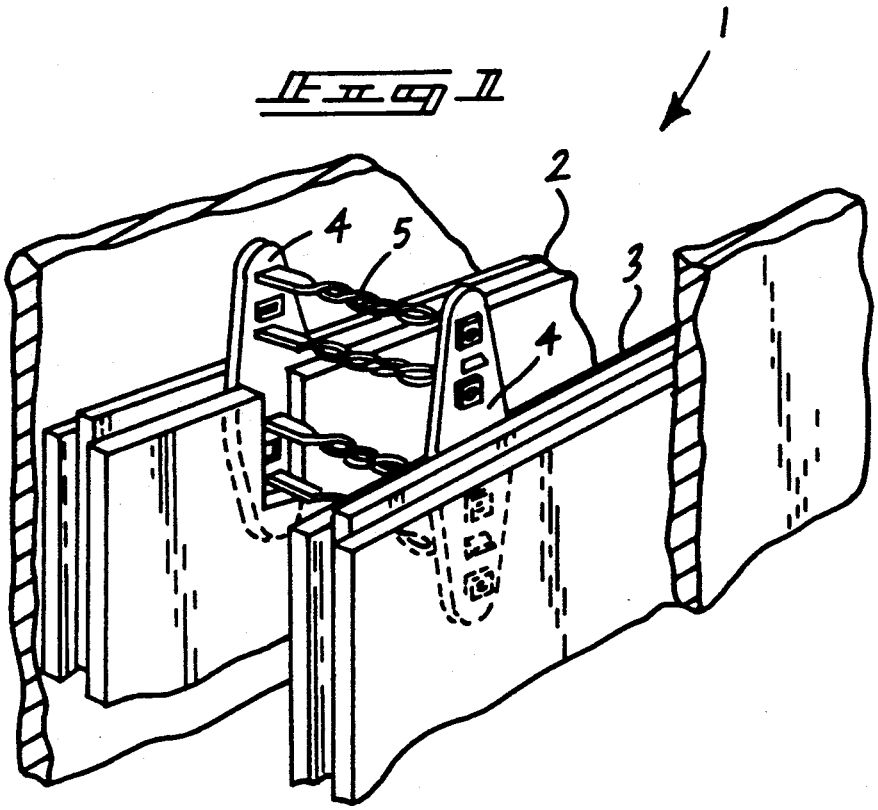
FIG. 1 is an isometric illustration of a prior art insulated wall construction.
Figure 2:
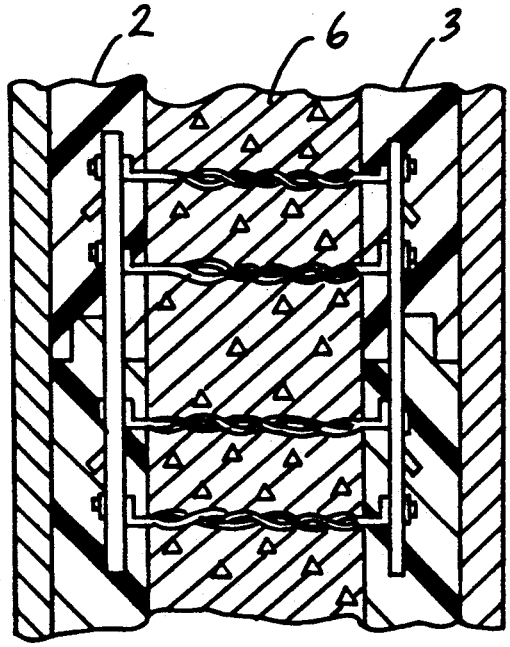
PRIOR ART FIG 2
FIG. 2 is an orthographic top view of the prior art construction, as illustrated in FIG. 1.

With reference now to the drawings, and in particular to FIGS. 1 to 22 thereof, a new and improved insulated wall construction embodying the principles and concepts of the present invention and generally designated by the reference numerals 10, 30, and 40 will be described.

FIG. 1 illustrates a prior art device 1, wherein spaced planar foam panels 2 and 3 utilize a medial unit, including spaced sheet metal members 4 secured together by twist rods 5 defining a unit that is received within slots within the panels to accommodate poured concrete 6 (see FIG. 2) to define a wall structure.

Figure 6:
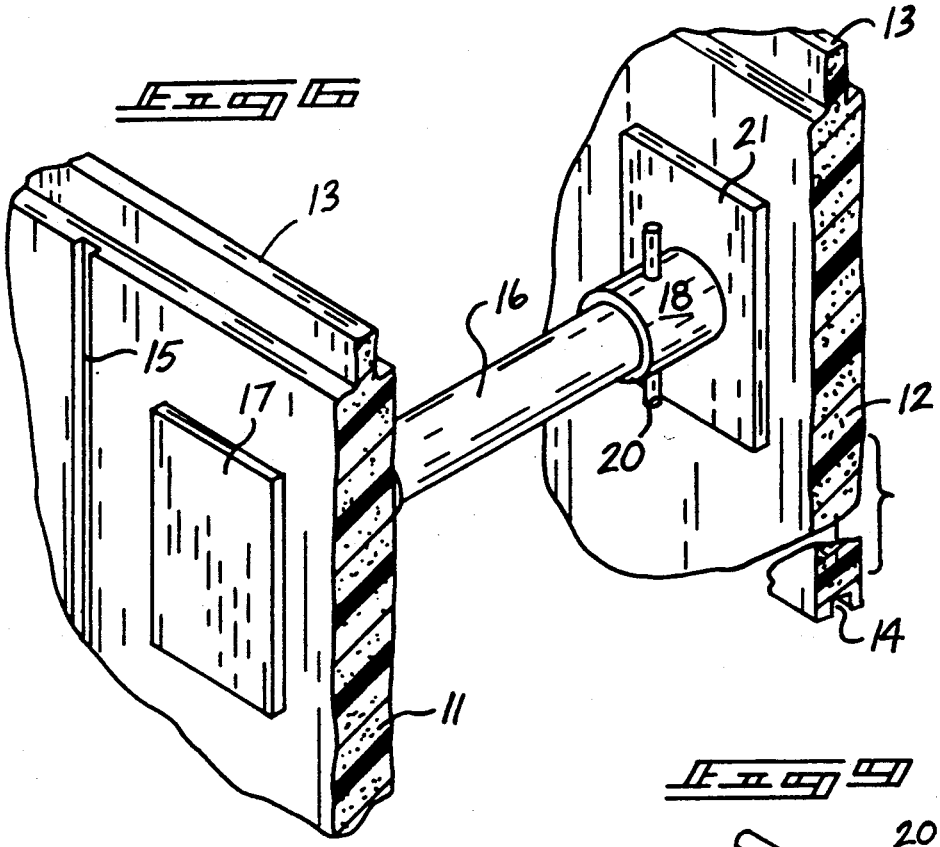
FIG. 6 is an isometric illustration of a support structure utilized by the instant invention between spaced planar foam panels.
Figure 9:
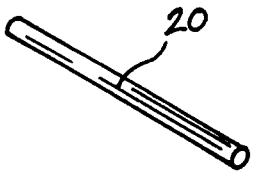
FIG. 9 is an isometric illustration of a lock pin utilized by the instant invention.
Figure 7:
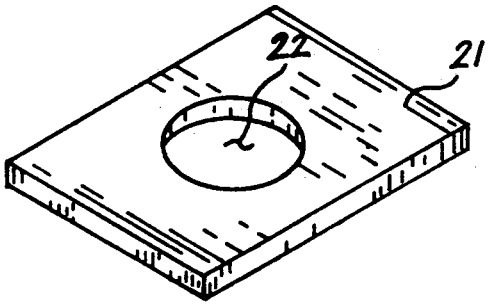
FIG. 7 is an isometric illustration of an internal support plate utilized by the instant invention.
Figure 10:
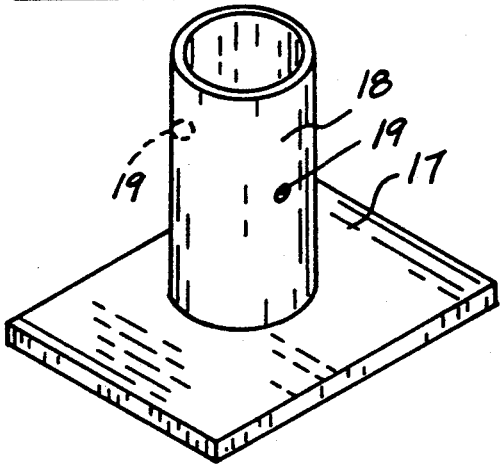
FIG. 10 is an isometric illustration of an external support plate and supporting rod utilized by the instant invention.
Figure 8:
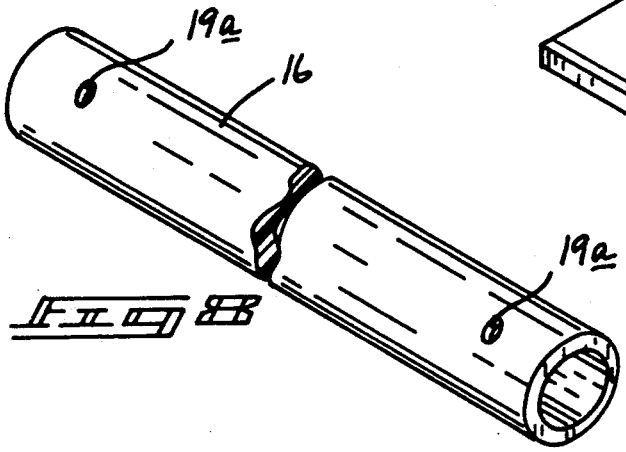
FIG. 8 is an isometric illustration of a support rod utilized by the instant invention.
Figure 11:
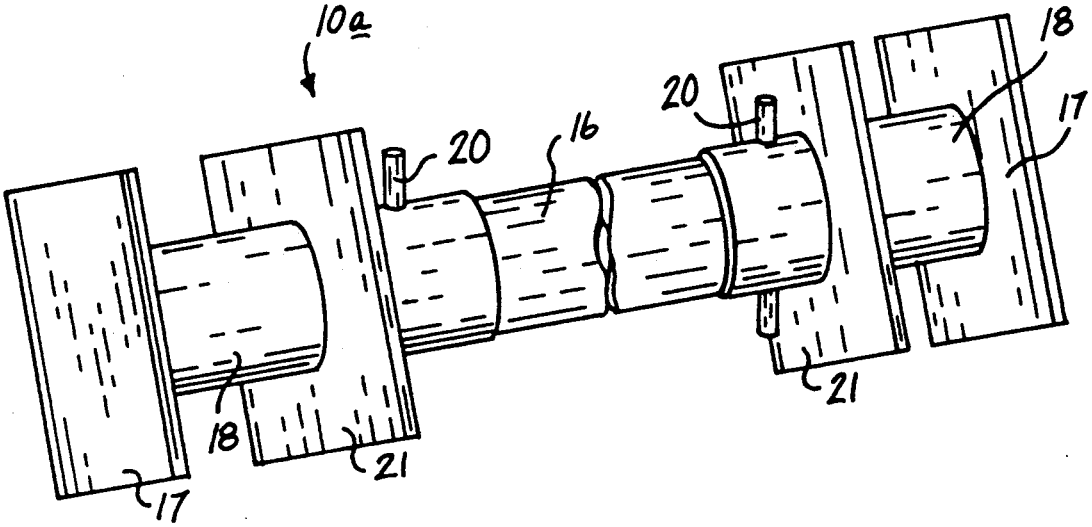
FIG. 11 is an isometric illustration of the support unit utilized by the instant invention.

More specifically, the insulated wall construction 10 of the instant invention essentially comprises a first foamed panel section 11 spaced from and parallel to a second foamed panel section 12. Each panel section includes an elongate ribbed member 13 integrally formed to a top and forward edge of each panel section complementarily received within an elongate groove 14 formed through each rear and bottom edge of each panel section to permit interlocking of the panel section together, in a relationship as illustrated in FIG. 3 for example, to accommodate concrete 6 poured and directed therebetween. Further, optional vertical drainage grooves 15 arranged in a parallel vertical relationship at spacing along exterior faces of each panel section are formed to permit drainage when the panel sections are utilized in a below-ground construction forum, such as in foundations and the like. To secure the first and second panel sections together in a predetermined relationship at a predetermined spacing therebetween, support units 10a (see FIG. 11) are provided. The support units are positioned orthogonally relative to each panel section at predetermined spacings. For example, to accommodate various building codes, sixteen inch spacings are typically utilized, but it is understood that various spacings to accommodate various codes and the like may be provided. The support units each include a spacer rod 16 (see FIGS. 6, 8, and 11) wherein the spacer rods are provided in various lengths to effect wall construction of various widths, dependent upon building code and construction requirements. Each support unit includes an external support plate 17, each support plate 17 includes an external support plate rod support 18, each rod support 18 is integrally and orthogonally mounted to an interior surface of each support plate, wherein each rod support is defined by a predetermined length greater than a predetermined thickness of each panel section to direct each rod support through each panel section in an orthogonal relationship. It is understood that each rod support 18 directed through each panel section is in a coaxially aligned relationship to receive the spacer tube between opposed tube supports 18, as illustrated in FIG. 6 for example. Each rod support is defined by an internal rod support diameter substantially equal to an external diameter defined by each spacer rod. Further, each rod support includes aligned locating bores 19 spaced from an internal surface of each support plate, in a manner as illustrated in FIG. 10, to receive a lock pin 20 therethrough. The lock pin 20 is directed through each pair of aligned rod supports locating bores 19, as well as aligned locating bores directed adjacent each end of each spacer rod to thereby lock each spacer rod within each rod support 18, in a manner as illustrated in FIG. 6. It is understood that the spacer rod locating bores 19*a*, as well as the rod support locating bores 19, are arranged in alignment orthogonally oriented relative to each axis defined by the rod support 18 and the spacer rod 16 respectively. An inner support plate 21 is captured between each lock pin 20 and each internal surface of each panel section 11 and 12 to provide support and reinforcement for each panel section. Each inner support plate 21 includes an inner support plate opening 22 defined by an inner support plate opening diameter substantially equal to an external diameter defined by each rod support 18. The external surface of each external support plate accordingly accommodates securement of various coverings, such as gypsum board, stucco, and the like, providing anchoring therefore. For example, gypsum board may be secured utilizing self-tapping sheet metal screws to accordingly fixedly secure such covering to each external surface of each external support plate 17. It is understood that subsequent to the pouring of the concrete 6 between interior surfaces of the first and second panel sections 11 and 12, the covering such as gypsum board is secured providing superior insulative qualities to the finished wall construction. Also, the tubular construction of the spacer tubes 16 and the associated rod support 18 provide limited resistance to the pouring of concrete between the spaced panel sections limiting the occurrence of voids within the concrete.

As required, reinforcing bar may be positioned in overlying relationship to the spacer tubes to provide convenient positioning and securement of reinforcing bar if such is deemed necessary.

Figure 12:
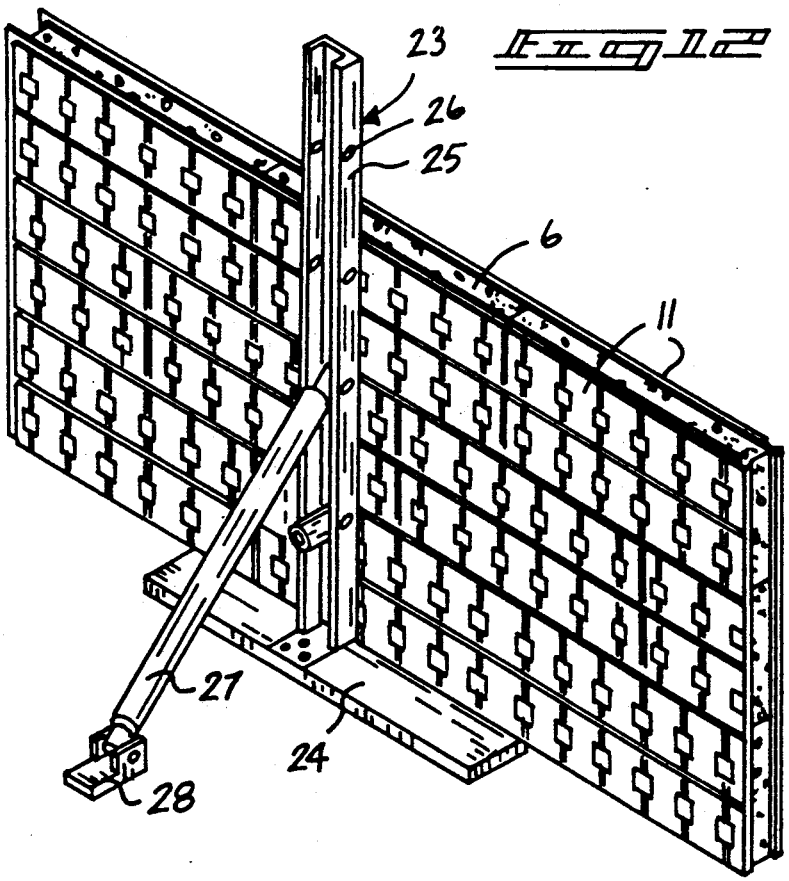
FIG. 12 is an isometric illustration of a wall unit and support member utilized by the instant invention.
Figure 13:
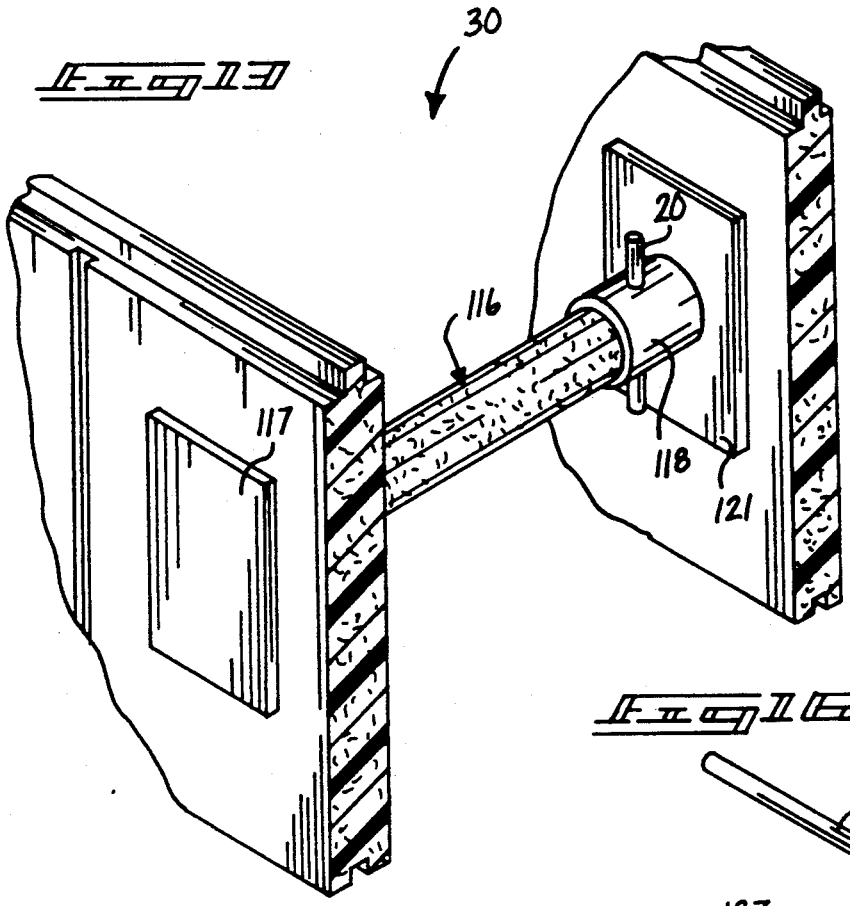
FIG. 13 is an isometric illustration of a modified organization of the instant invention.
Figure 16:
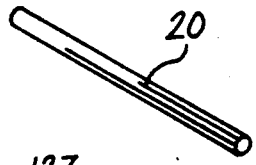
FIG. 16 is an isometric illustration of a lock pin utilized by the invention.
Figure 14:
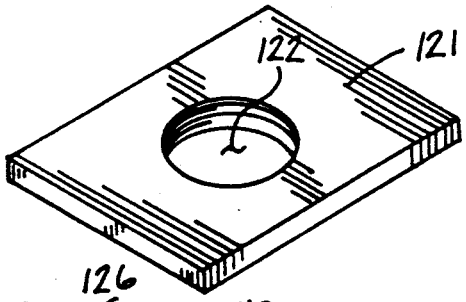
FIG. 14 is an isometric illustration of a modified inner support plate utilized by the instant invention.
Figure 17:
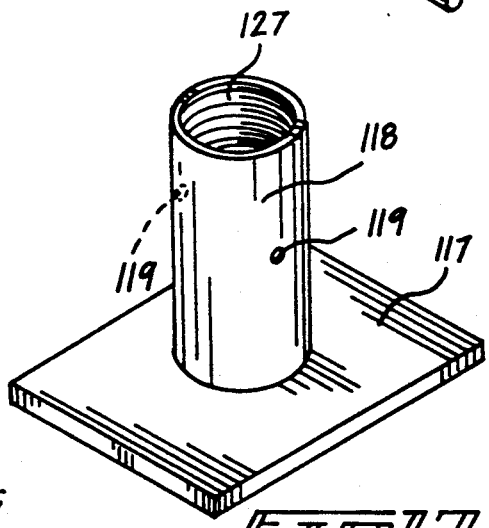
FIG. 17 is an isometric illustration of an external modified support plate tube utilized by the instant invention.
Figure 15:
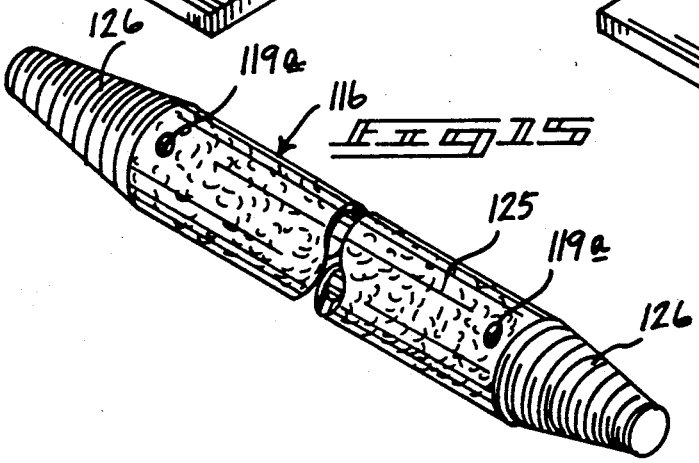
FIG. 15 is an isometric illustration of a support rod utilized by the instant invention.

Reference to FIG. 12 illustrates the use of a support member 23, wherein the support member includes a base plate 24 positionable adjacent a matrix of the first and second panel sections and their associated support units secured together to accommodate concrete 6 poured therebeteween. The base plate 24 includes a "U" shaped channel 25 fixedly and orthogonally mounted to a top surface of the base plate adjacent a forward edge of the base plate to provide support vertically to the column of panel sections. The "U" shaped channel receives an upper end of a support rod 27 that is secured between a "U" shaped channel 25 by aligned opening pairs 26 cooperative with openings formed within the support rod 27. A lower terminal end of the support rod 27 is secured to a foot member 28 to triangulate the support rod and provide support to the wall construction, as illustrated in FIG. 12, during curing of the concrete 6.

Figure 18:
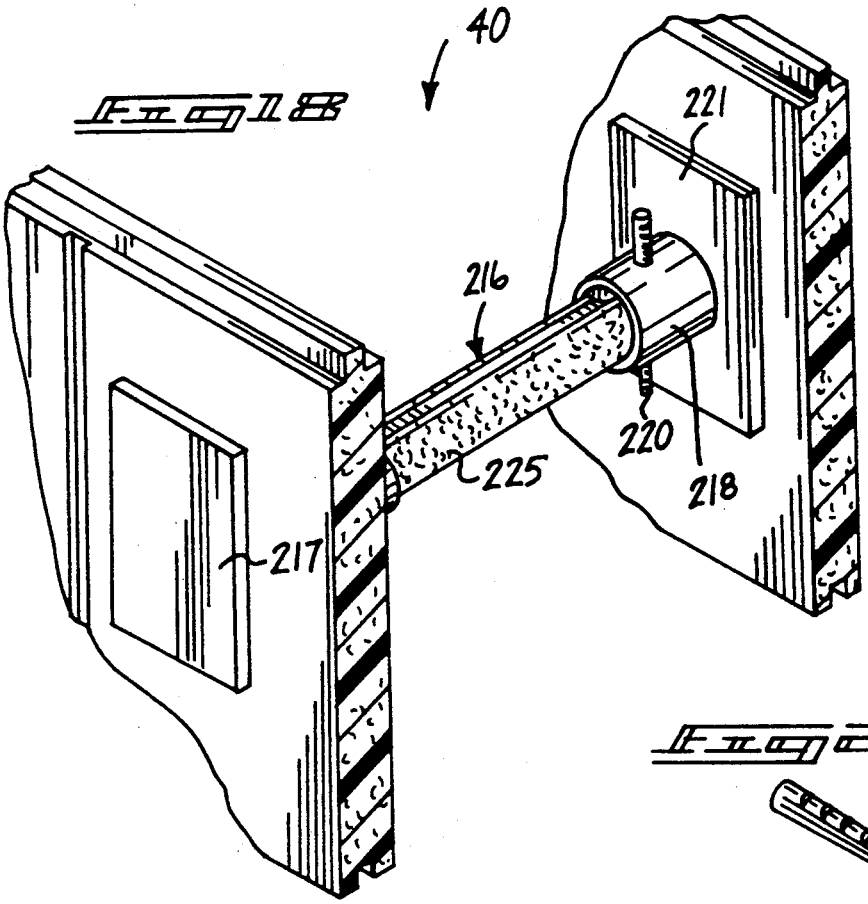
FIG. 18 is an isometric illustration of a yet further modified support structure utilized by the instant invention.
Figure 21:
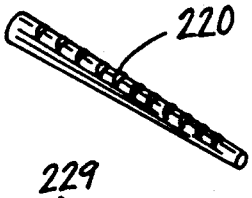
FIG. 21 is an isometric illustration of a modified lock pin utilized by the instant invention.
Figure 19:
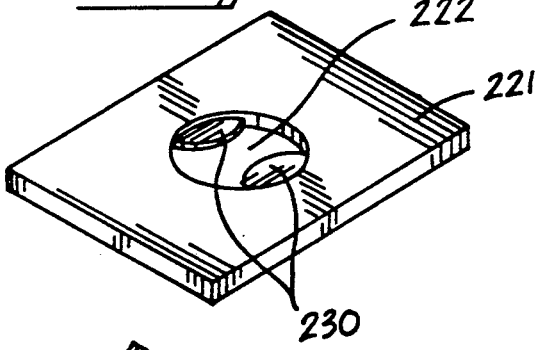
FIG. 19 is an isometric illustration of a further modified internal support plate utilized by the instant invention.
Figure 22:
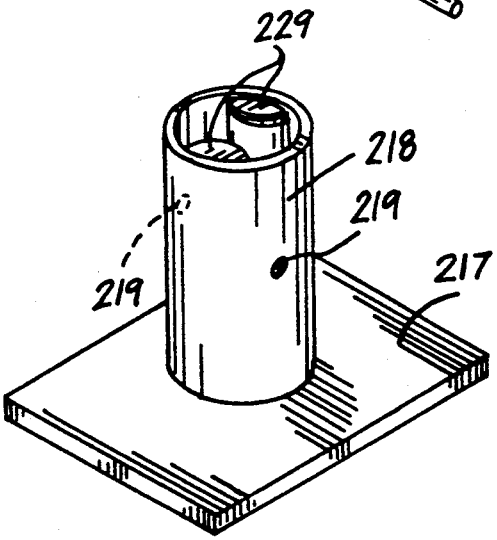
FIG. 22 is an isometric illustration of a further modified external support plate and tube utilized by the instant invention.
Figure 20:
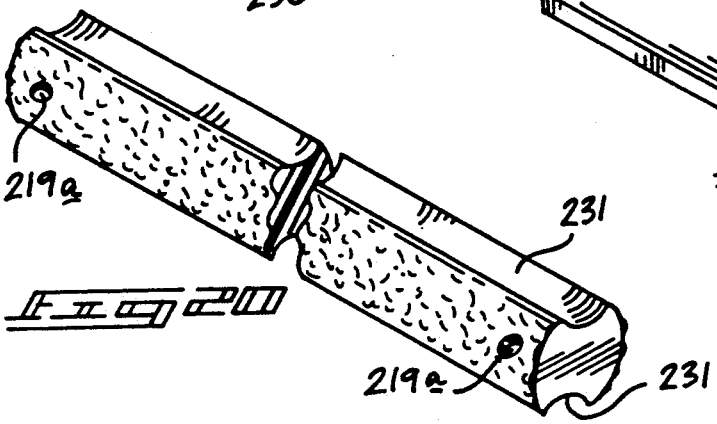
FIG. 20 is an isometric illustration of a further modified support rod utilized by the instant invention.

The modified support organization 30, as illustrated in FIGS. 13–17, includes a modified spacer rod 116, including an external cylindrical surface 125 formed with externally threaded terminal end portions 126 at each terminal end thereof threadedly receivable within internally threaded inner support openings 122 and internally threaded support tube surface 127 of each tube support 118 that is fixedly mounted to an external support plate 117. Locating bores 119 are diametrically aligned within the tube support 118 for registration with the spacer tube locating bores 119*a* diametrically directed through each reference cylindrical surface 125 adjacent each externally threaded terminal end portion 126 to permit threaded mounting of the modified spacer rod 116 in an assembled configuration relative to the modified tube support 118 and the internally threaded support plate 121. Similarly, the further modified organization 40, as illustrated in FIGS. 18–20, utilizes a further modified spacer rod 216 that includes an externally threaded external surface utilizing diametrically opposed flutes 231 of a generally semicylindrical configuration formed on diametrically opposed sides of each further modified spacer rod 216. The further modified internal support plates 221 utilize a modified inner support plate opening 222 that includes diametrically opposed semicylindrical planar projections 230 that are in planar alignment relative to one another and extend in diametrically opposed relationship relative to one another to be received within the opposed flutes 231. The use of a further modified tube support 218 includes a plurality of diametrically opposed semicylindrical projections 229 that are coextensively directed through the inner surface of each further modified tube support 218 to receive the flutes 231. The further modified locating bores 219 are directed through the further modified tube support 219 for alignment with further modified spacer tube locating bores 219*a* to receive a further modified lock pin 220. The lock pin 220 includes a conical configuration formed with a stepped exterior surface to enhance securement of the lock pin 220 within the associated locating bores.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulated wall construction comprising, in combination, a first foam panel section spaced from a second foam panel section, the first panel section including a first internal surface spaced from a first external surface, the second panel section including a second internal surface spaced from a second external surface, the first internal surface and the second internal surface in confronting relationship relative to on another, and a plurality of support units mounted selectively between the first and second panel sections to secure the panel sections together, the support units spaced apart a predetermined spacing, and wherein the support unit includes a first and second external support plate, each first and second external support plate including a first and second rod support fixedly and orthogonally mounted to each external support plate, each first and second tube support directed through each respective first and second panel section arranged orthogonally relative to the first and second internal surface of each first and second panel section, wherein each first and second rod support are in an aligned relationship relative to one another, and a spacer rod received within each first and second rod support, the spacer rod selectively secured to each respective first and second rod support, and wherein each rod support includes a plurality of rod support locating bores orthogonally directed through each rod support relative to a rod support axis defined by the rod support relative to a rod support axis defined by the rod support, and each spacer rod including a first pair of spacer rod locating bores and a second pair of spacer rod locating bores, each first and second pair of locating bores orthogonally directed through the spacer rod orthogonally aligned relative to an axis defined by the spacer rod, wherein the first and second pair of spacer rod locating bores are positioned adjacent respective opposed terminal ends of each spacer rod, and each pair of spacer rod locating bores are aligned with each plurality of tube support locating bores formed within each first and second tube support, and including a lock pin received through the first and second spacer rod locating bores and respective first and second tube support locating bores aligned with the first and second spacer tube locating bores, and including an inner support plate captured between each lock pin and each respective first and second panel section interior surface, each inner support plate including an inner support plate opening defining a predetermined diameter substantially equal to an external diameter defined by each tube support, and wherein each rod support defines an inner rod support diameter substantially equal to an external spacer tube diameter defined by each spacer rod to complementarily receive the spacer rod within each rod support, and including a support member positionable against an external surface of each first panel section, the support member including a base plate, and a "U" shaped channel fixedly and integrally mounted in an orthogonal orientation relative to each base plate, and a support rod secured within the "U" shaped channel at an upper end of each support rod, and a lower end of the support rod secured to a foot member to position the "U" shaped channel against the first exterior surface of the first panel section, and wherein each tube support includes a plurality of diametrically opposed semicylindrical coextensive projections mounted within each tube support, and each spacer rod includes a plurality of diametrically opposed semi-cylindrical plates coplanar with one another to be received within the semicylindrical flutes, and wherein each spacer rod is formed with a roughened exterior surface to enhance adhesion of concrete thereto, and wherein each spacer rod includes externally threaded end portions, and each tube support includes an internally threaded surface to receive each externally threaded end portion, and each inner tube support plate includes an internally threaded central bore for receiving each respective externally threaded end portion thereof.

* * * * *